US008590099B2

(12) United States Patent
Sang et al.

(10) Patent No.: US 8,590,099 B2
(45) Date of Patent: Nov. 26, 2013

(54) VACUUM CLEANER HAVING DETACHABLE BLOWER AND RELATED LOCKING ASSEMBLY

(75) Inventors: Shuhua Sang, Suzhou (CN); Juan Wei, Suzhou (CN)

(73) Assignee: Suzhou Cleva Electric Appliance Co. Ltd., Suzhou (CN)

( * ) Notice: Subject to any disclaimer, the term of this patent is extended or adjusted under 35 U.S.C. 154(b) by 655 days.

(21) Appl. No.: 12/466,876

(22) Filed: May 15, 2009

(65) Prior Publication Data

US 2009/0282640 A1 Nov. 19, 2009

(30) Foreign Application Priority Data

May 15, 2008 (CN) ..... 2008 2 0116314 U
May 16, 2008 (CN) ..... 2008 2 0111712 U

(51) Int. Cl.
*A47L 5/00* (2006.01)
*A47L 9/00* (2006.01)

(52) U.S. Cl.
USPC ..... 15/327.1; 15/328; 15/330

(58) Field of Classification Search
USPC ..... 15/327.1, 328, 330
See application file for complete search history.

(56) References Cited

U.S. PATENT DOCUMENTS

| | | | | | |
|---|---|---|---|---|---|
| 4,880,364 | A * | 11/1989 | Berfield et al. | ..... | 417/423.1 |
| 5,611,107 | A * | 3/1997 | Tomasiak et al. | ..... | 15/327.2 |
| 6,101,669 | A * | 8/2000 | Martin et al. | ..... | 15/327.2 |
| 6,158,083 | A * | 12/2000 | Holsten | ..... | 15/326 |
| 6,640,384 | B2 * | 11/2003 | Sanders et al. | ..... | 15/330 |
| 2002/0108205 | A1 | 8/2002 | Berfield et al. | | |
| 2005/0155177 | A1 * | 7/2005 | Baer et al. | ..... | 15/353 |

* cited by examiner

*Primary Examiner* — Bryan R Muller
(74) *Attorney, Agent, or Firm* — Dority & Manning, P.A.

(57) ABSTRACT

A vacuum cleaner includes a dirt tank, a tank cover mounted on the dirt tank, and a blower detachably mounted on the tank cover and including a main body. The blower forms a single handle which is located on a top face of the main body. Thus, the vacuum cleaner can be easily lifted up by one single hand of an operator due to the single handle located on a top face of the main body of the blower. A locking assembly for a vacuum cleaner including a tank cover and a blower detachably engaged with the tank cover is arranged between the tank cover and the blower. The locking assembly includes a latch, a resilient member and a locking shoulder, the resilient member being connected between the blower and the latch, the latch being pivotally mounted at the blower and engageable with the locking shoulder. Therefore, the blower is easily and reliably attached with or detached from the tank cover via the locking assembly which includes the latch and the locking shoulder simply latching with or detaching from each other.

6 Claims, 14 Drawing Sheets

VACUUM CLEANER HAVING DETACHABLE BLOWER AND RELATED LOCKING ASSEMBLY

TECHNICAL FIELD

The present disclosure relates to a vacuum cleaner, and more particularly to a vacuum cleaner having a detachable blower, and to a related locking assembly.

BACKGROUND

Presently, one type of vacuum cleaner having a detachable blower may perform blowing or sucking operation. The detachable blower is commonly attached to or detached from a body of the vacuum cleaner via a locking assembly. When the vacuum cleaner needs to perform blowing operation, the blower is detached from the body for separately processing blowing operation, such as blowing debris from a machine table to the ground before sucking operation, or blowing dispersive debris or leaves together for conveniently vacuum or clearing. As shown in U.S. Pat. No. 4,880,364 and U.S. Patent Publication Number 2002/0108205, a vacuum cleaner having a detachable blower disclosed in either of them forms two hand grip portions on two opposite sides of the detachable blower for the user to grip the blower. However, for such a vacuum cleaner, the user must grip the two hand grip portions with both hands to lift the whole vacuum cleaner. If one hand of the user is wounded or carrying other objects, she/he can not lift the whole vacuum cleaner, thereby such a vacuum cleaner is inconvenient in use.

In a vacuum cleaner having a detachable blower, the body commonly includes a dirt tank and a tank cover located between the dirt tank and the blower. A drive motor and an impeller are mounted in a housing of the blower for generating low pressure suction force in the dirt tank to thereby suck debris, dust or liquid waste into the dirt tank through a hose mounted at the dirt tank. The vacuum cleaner has blowing and sucking function, and when it is used for blowing function, the blower is detached from the vacuum cleaner for independently processing blowing function. Accordingly, a locking assembly is arranged between the dirt tank and the blower, for attaching or detaching the blower from the dirt tank. However, referring to U.S. Patent Publication Number 2002/0138938, a locking assembly disclosed therein can not reliably lock the blower with the dirt tank, so the blower maybe accidentally break away from the dirt tank.

SUMMARY

To overcome one or more the shortcomings of vacuum cleaners having a detachable blower, or to provide other benefits, the present disclosure provides a vacuum cleaner which is convenient in use. Also, the present disclosure provides a detachable blower which can reliably and conveniently be locked or unlocked from the vacuum cleaner body.

If desired, according to some aspects of the disclosure, a vacuum cleaner may include a detachable blower, a dirt tank, and a tank cover mounted on the dirt tank. The blower may be detachably mounted on the tank cover and include a main body with a single handle, the single handle located on a top face of the main body.

Also, according to certain other aspect of the disclosure, a locking assembly is disclosed for a vacuum cleaner with a detachable blower, the vacuum cleaner including a tank cover and the blower being detachably engaged with the tank cover. The locking assembly may be arranged between the tank cover and the blower. The locking assembly may include a latch, a resilient member and a locking shoulder, the resilient member being connected between the blower and the latch, the latch being pivotally mounted at the blower and engageable with the locking shoulder.

BRIEF DESCRIPTION OF THE DRAWINGS

The present disclosure will be further described with reference to the accompanying drawings and embodiments below.

DETAILED DESCRIPTION

Figure 1:
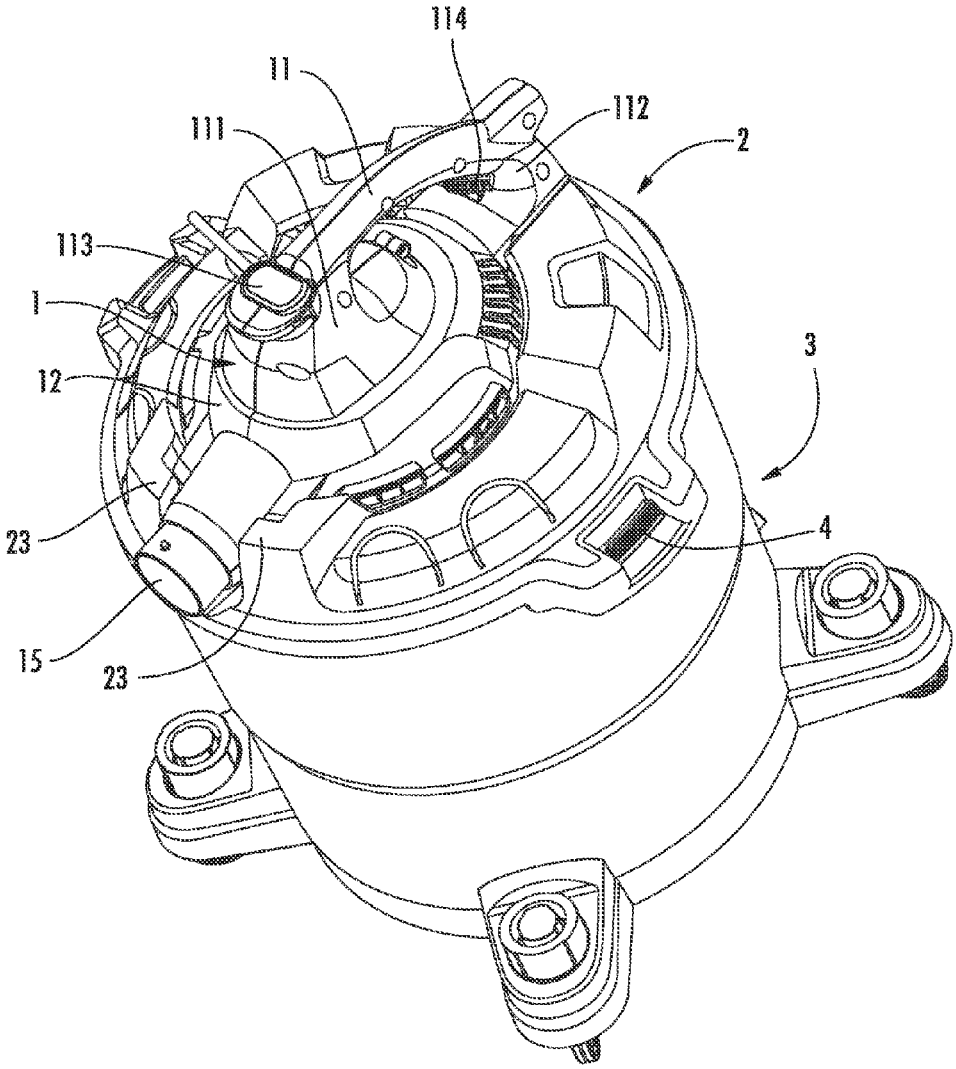
FIG. 1 is a perspective view of a vacuum cleaner having a detachable blower according to certain aspects of the disclosure.
Figure 2:
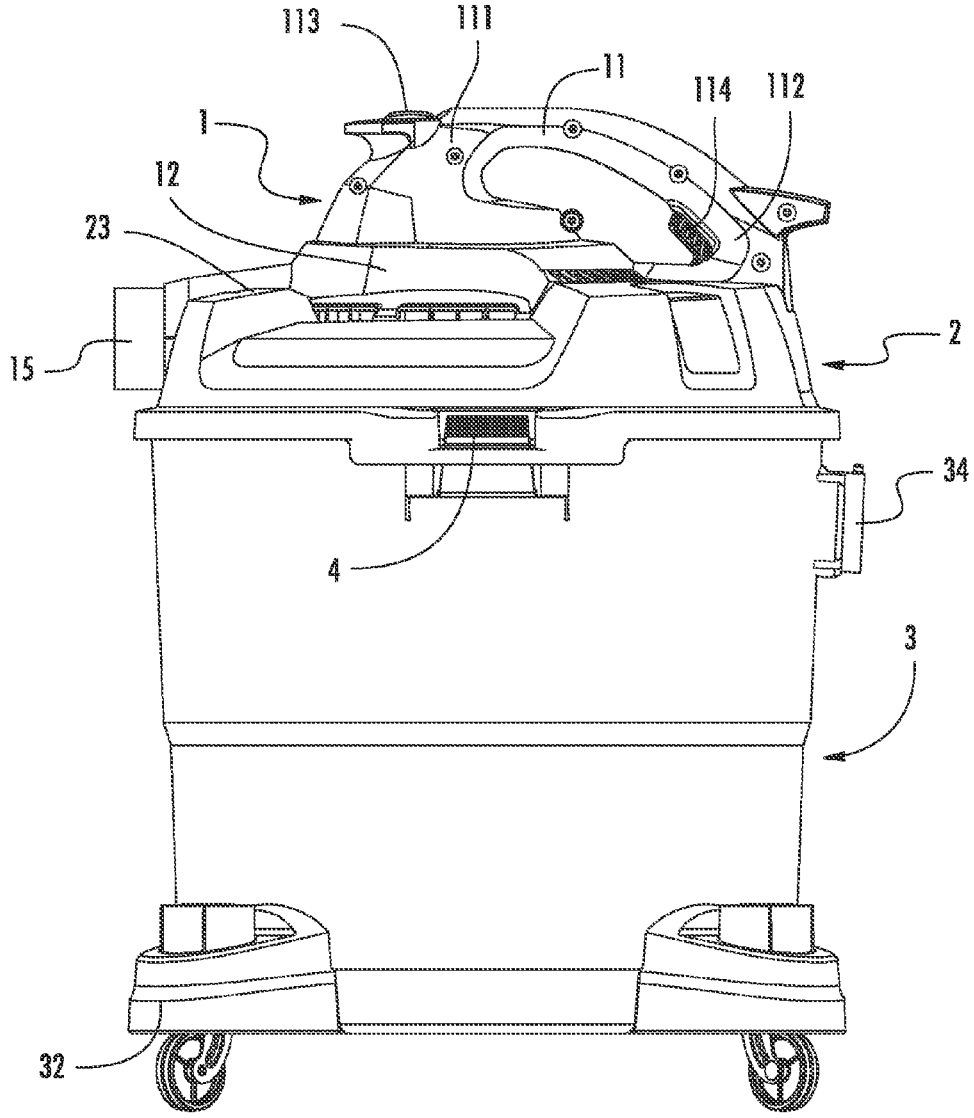
FIG. 2 is a front planar view of the vacuum cleaner in FIG. 1.
Figure 3:
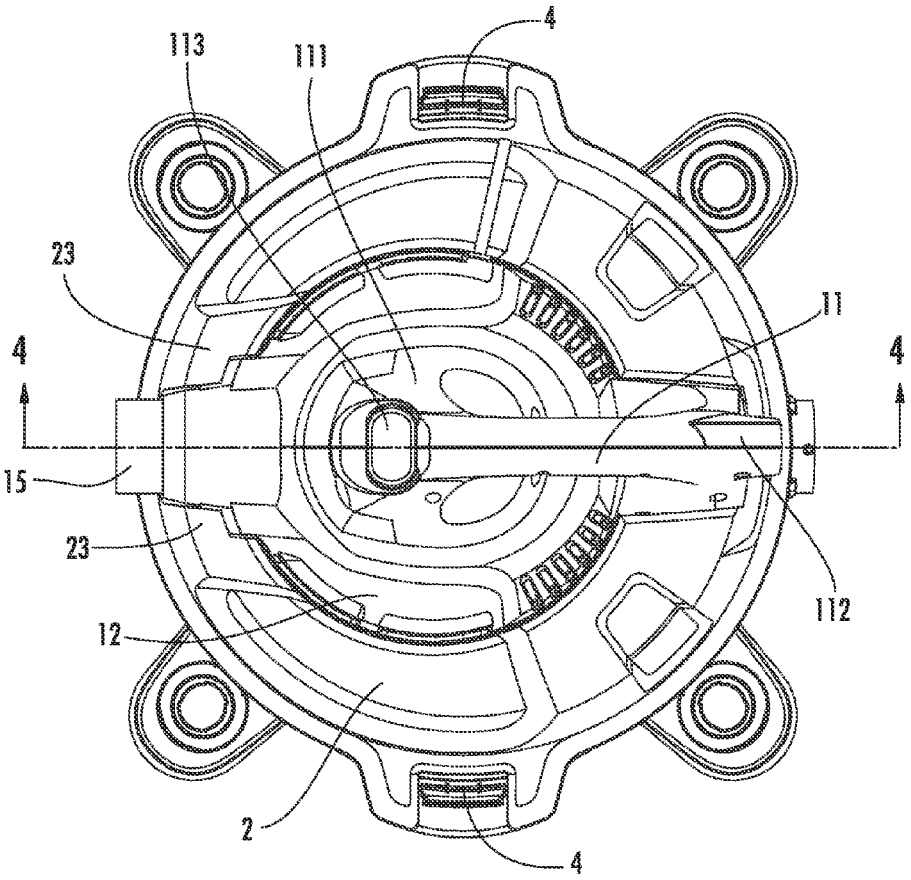
FIG. 3 is a top planar view of the vacuum cleaner in FIG. 1.

Detailed reference will now be made to the drawings in which examples embodying the present disclosure are shown. The detailed description uses numerical and letter designations to refer to features in the drawings. Like or similar designations in the drawings and description have been used to refer to like or similar parts of the embodiments.

The drawings and detailed description provide a full and detailed written description of the disclosed subject matter, and the manner and process of making and using it, so as to enable one skilled in the art to make and use it, as well as the best mode of carrying out the disclosed subject matter. However, the examples set forth in the drawings and detailed descriptions are provided by way of explanation of the subject matter and are not meant as limitations of the subject matter. The inventions encompassed by this disclosure therefore include any modifications and variations of the following examples as come within the scope of the appended claims and their equivalents.

Referring to FIGS. 1 to 5, a vacuum cleaner according to one embodiment of the present subject matter includes a blower 1, a dirt tank 3, and a tank cover 2 located between the blower 1 and the dirt tank 3.

The dirt tank 3 includes a plurality of wheeled casters 32 mounted at a circumference of a bottom portion thereof, and a wind outlet 34 on a top portion thereof.

Figure 4:
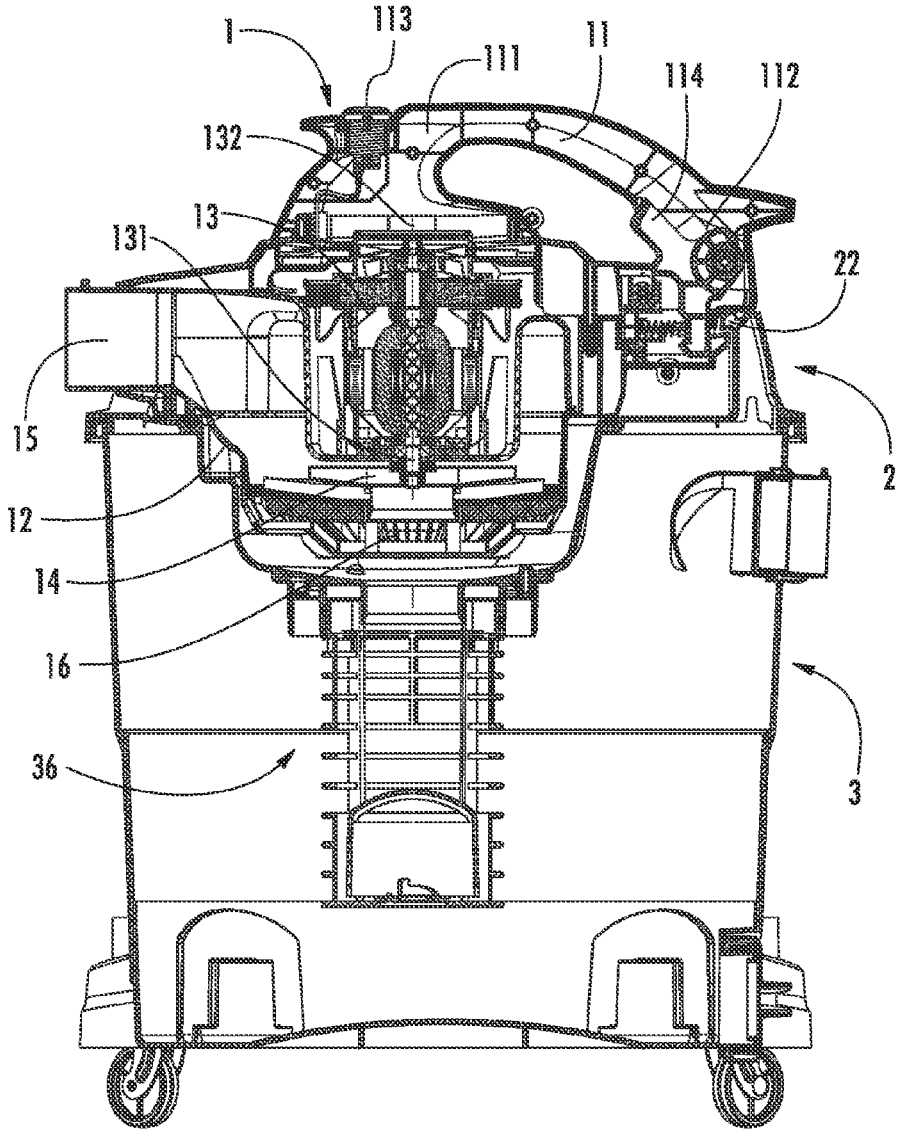
FIG. 4 is a cross-sectional view of the vacuum cleaner of FIG. 1 taken along the line 4-4 in FIG. 3.
Figure 6:
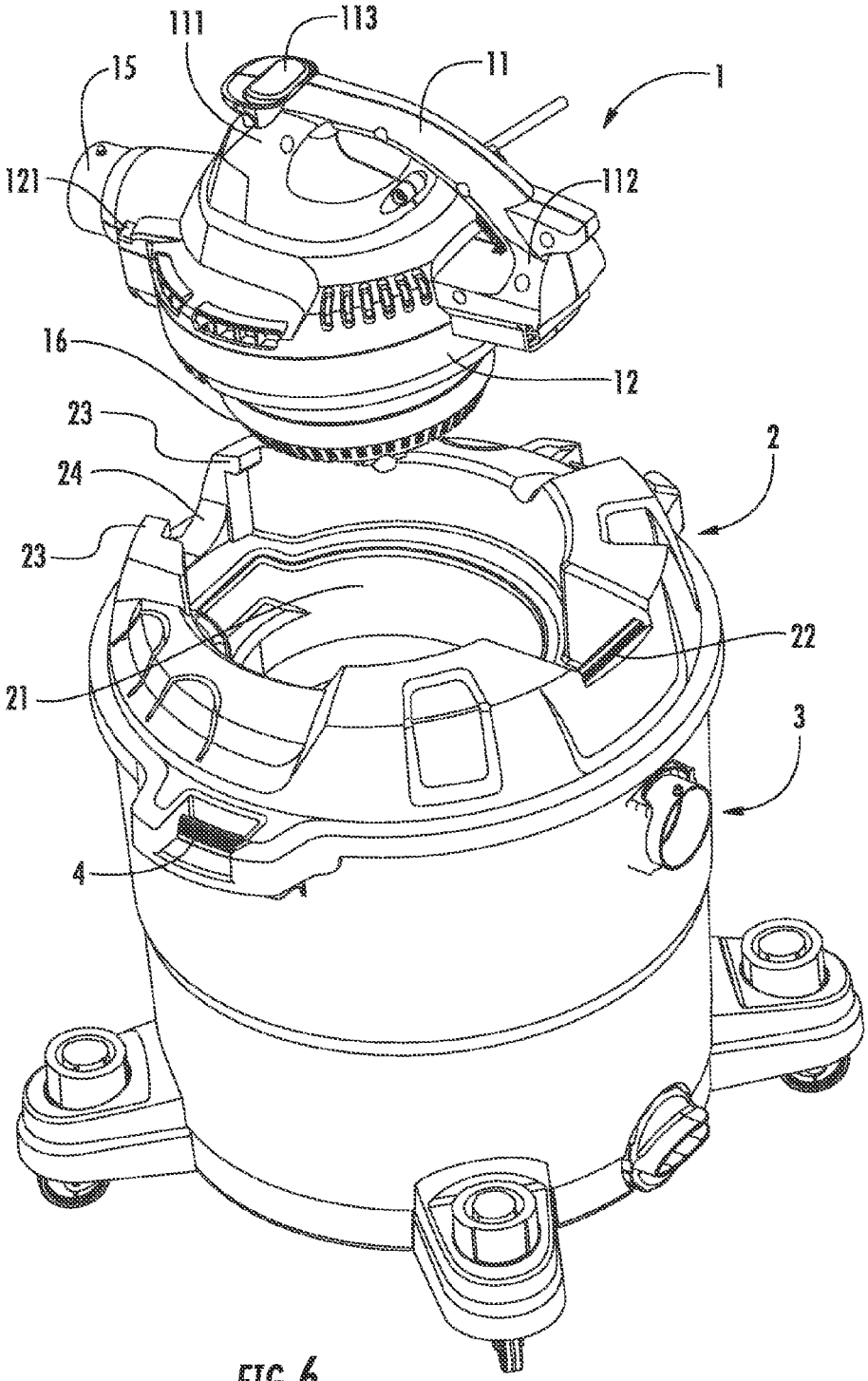
FIG. 6 is a partially exploded perspective view of the vacuum cleaner in FIG. 1.

The tank cover 2 is attached to the dirt tank 3 via a latch 4, and defines a receiving chamber 21 (see FIG. 6) in a top face thereof for receiving the blower 1. As shown in FIG. 4, a filter mechanism 36 is mounted at a bottom portion of the tank cover 2 and located in the dirt tank 3. Further referring to FIG. 6, the tank cover 2 further includes a locking shoulder 22 and a U-shaped cutout 24 which are located at the top face thereof opposite each other and communicating with the receiving chamber 21. Furthermore, a pair of latching shoulders 23 is formed at both sides of the cutout 24.

Figure 7:
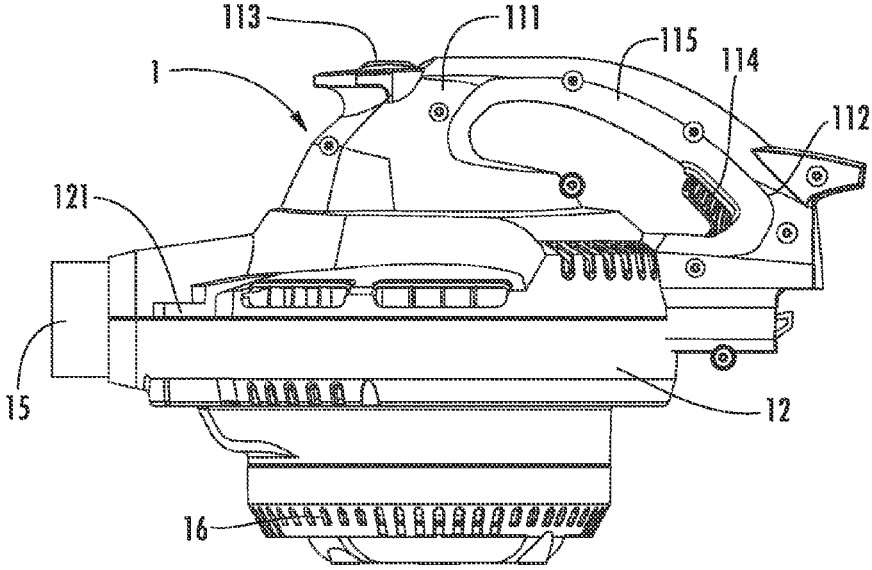
FIG. 7 is a front planar view of the blower of the vacuum cleaner in FIG. 1.
Figure 8:
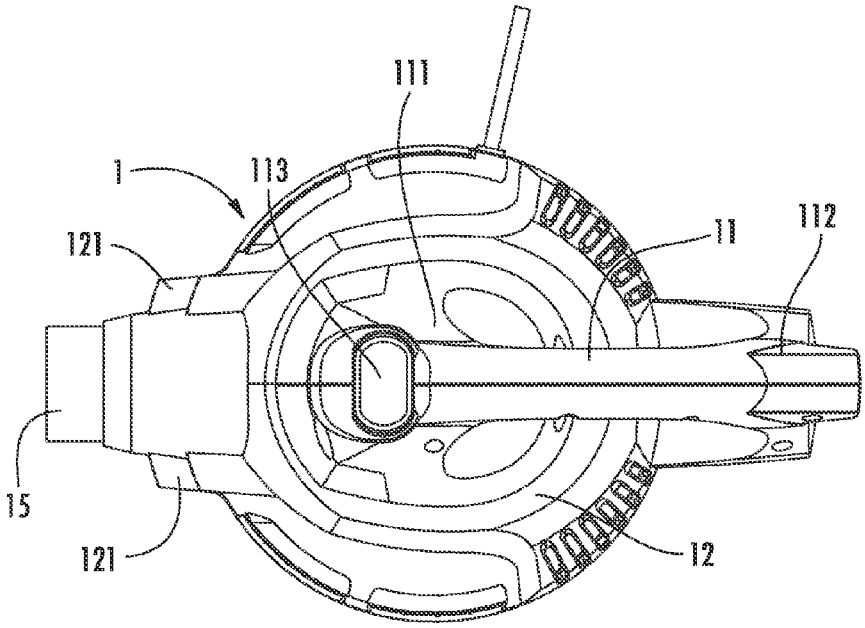
FIG. 8 is a top planar view of the blower of the vacuum cleaner in FIG. 1.

Further referring to FIGS. 7 to 8, the blower 1 includes a main body 12. A drive motor 13 and an impeller 14 assembled with the drive motor 13 are mounted in the main body 12. A plate 16 having a plurality of wind inlets 162 are arranged at a bottom of the main body 12. The main body 12 together with the plate 16 is received into the receiving chamber 21. The blower 1 forms a blowing outlet 15 at one side of the main body 12. A pair of abutting shoulders 121 is formed at both sides of the blowing outlet 15. When the blower 1 is mounted to the tank cover 2, the blowing outlet 15 is received in the cutout 24 and the abutting shoulders 121 are abutted beneath the pair of latching shoulder 23 of the tank cover 2.

Figure 5:
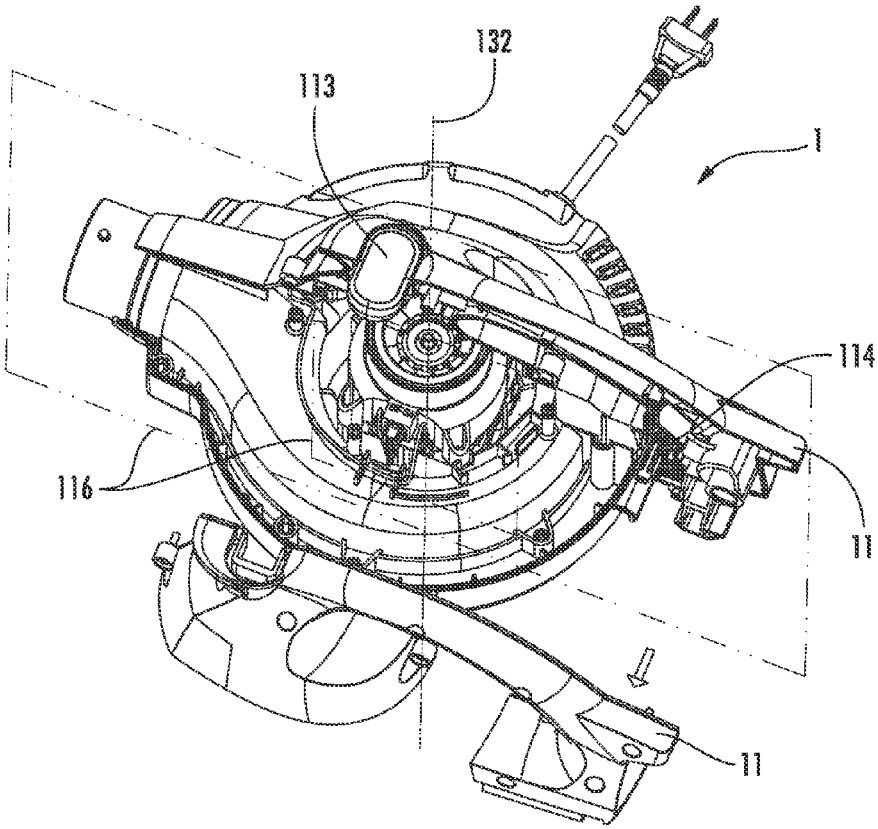
FIG. 5 is a partially exploded perspective view of a blower of the vacuum cleaner in FIG. 1.

Additionally, the blower 1 includes a single handle 11 on a top face 122 thereof. The handle 11 includes a front end portion 111 extending upward from the top face 122, a rear end portion 112 extending from a rear side of the main body 12, and a hand grip portion 115 connecting the front end portion 111 and the rear end portion 112. A power switch 113 is mounted on the front end portion 111. A locking assembly 114 is arranged at the rear end portion 112 as detailed below, engageable with the locking shoulder 22 of the tank cover 2, for attaching or detaching the blower 1 from the tank cover 2. The hand grip portion 115 is in an arc shape. As best seen in FIGS. 5 and 8, the handle 11 has a symmetrical construction with respect to a central plane 116 thereof, and is aligned with the blowing outlet 15. The blower 1 also has a substantially symmetrical construction, and the central plane 116 of the handle 11 is also a central plane of the blower 1.

According to the disclosed embodiment, the central plane 116 of handle 11 is coplanar with an axis 132 of a motor shaft 131 of the drive motor 13. Therefore, when the vacuum cleaner is to be lifted up, a user needs only one hand to carry on the single hand grip portion 115 and exert an upward force along the axis 132 of the motor shaft 131, thereby the vacuum cleaner can be easily lifted up via one hand of the user once the upward force exerted by the user is slightly larger than gravity of the vacuum cleaner extending downward along the axis 132 of the motor shaft 131. Alternatively, the axis 132 of the motor shaft 131 may be parallel to the central plane 116 of the handle 11, which is also practicable and only needs a slight larger upward force exerted on the hand grip portion 115 of the handle by the user's one hand.

Figure 9:
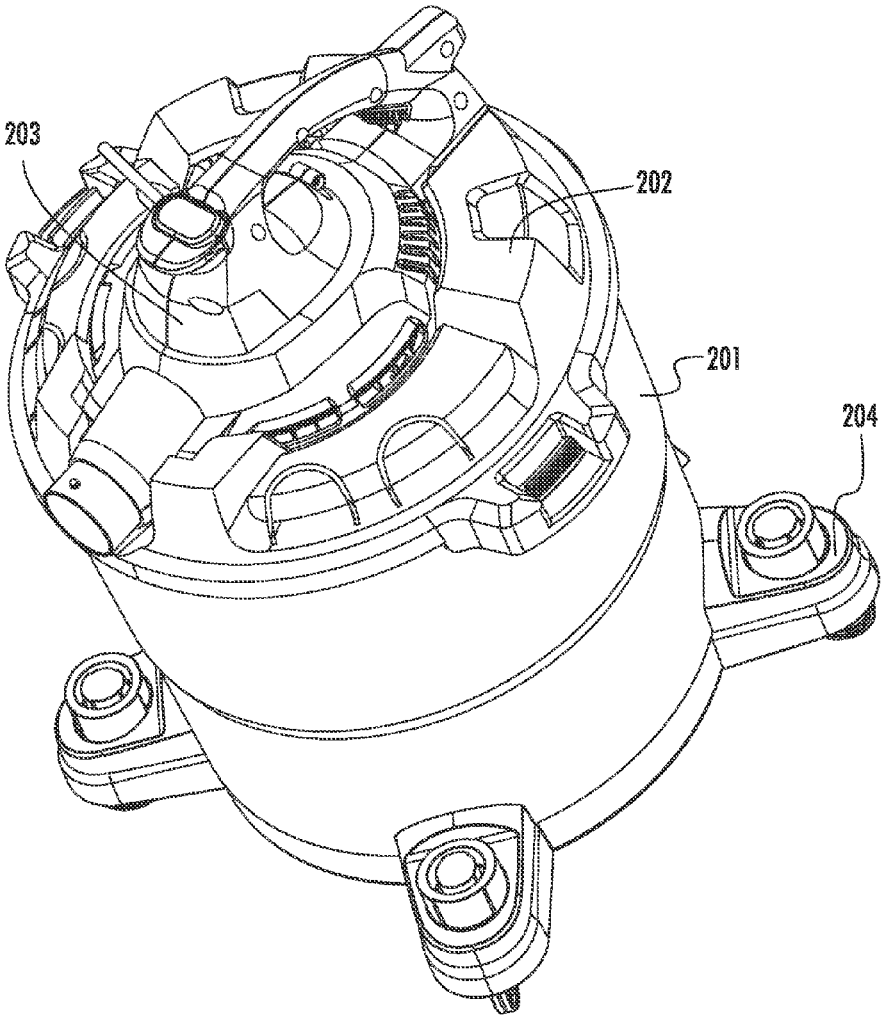
FIG. 9 is perspective view of a vacuum cleaner having a detachable blower according to certain aspects of the disclosure.
Figure 10:
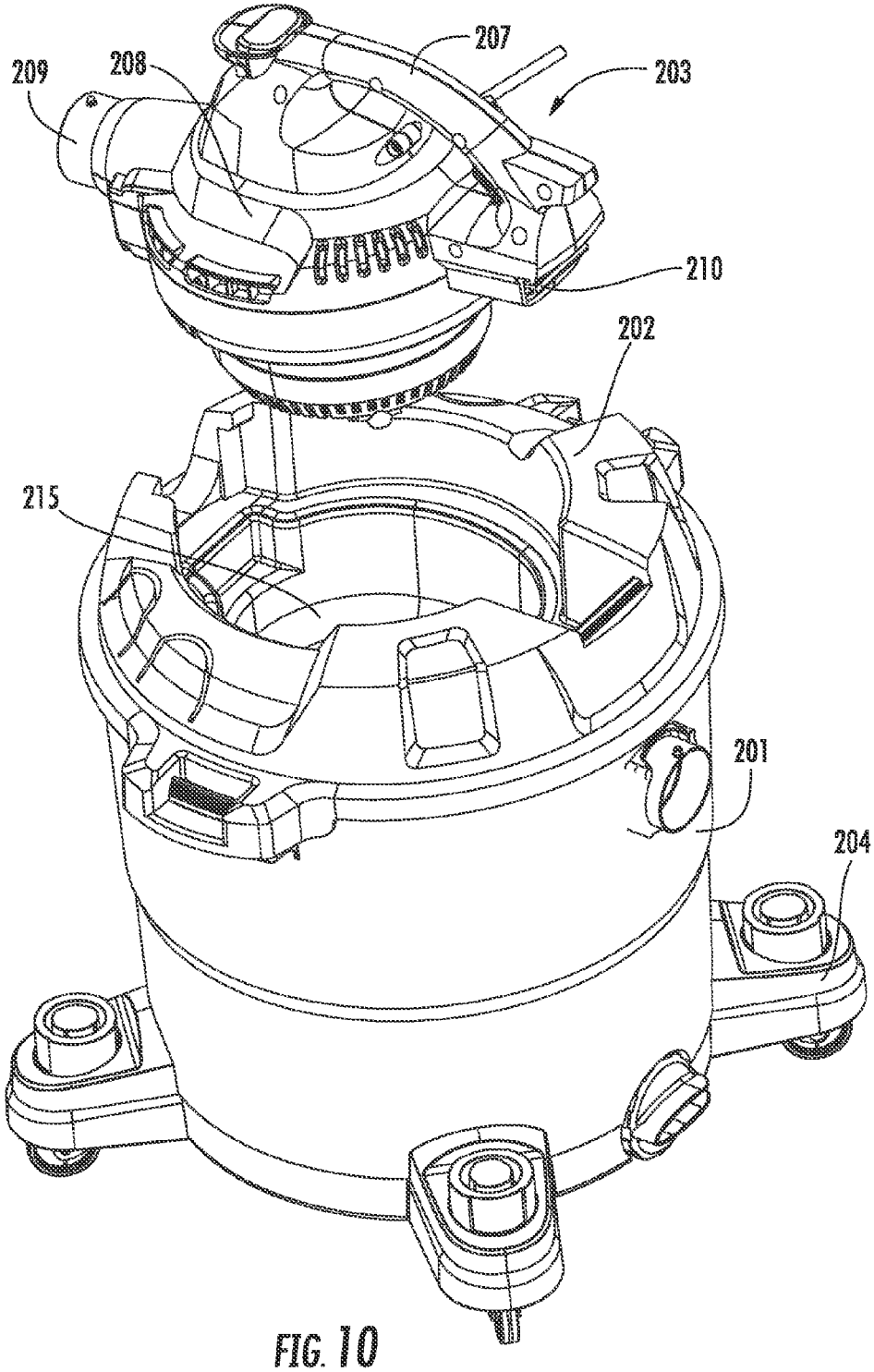
FIG. 10 is a partially exploded perspective view of a blower and a tank cover of the vacuum cleaner in FIG. 9.

FIGS. 9-15 show an alternate related vacuum cleaner design showing more details of a locking assembly. Referring to FIGS. 9 and 10, a perspective view of a vacuum cleaner according to a certain aspects of the present subject matter is shown. The vacuum cleaner includes a dirt tank 201, a tank cover 202 mounted on a top portion of the dirt tank 201, a detachable blower 203 mounted at the tank cover 202 and a universal wheel assembly 204 mounted on a bottom portion of the dirt tank 201. The blower includes a housing 208, a handle 207 mounted on a top surface (not labeled) of the housing 208 and a wind outlet 209 mounted at a side of the housing 208. A drive motor and an impeller (both not shown, see previous Figures) are disposed in the housing 208 for generating low-pressure suction force in the dirt tank to thereby suck debris, dust or liquid waste into the dirt tank through a hose (not shown) mounted to the dirt tank 201. The dirt tank 201 further defines a receiving chamber 215 in a top face thereof for receiving the blower 203.

Figure 11:
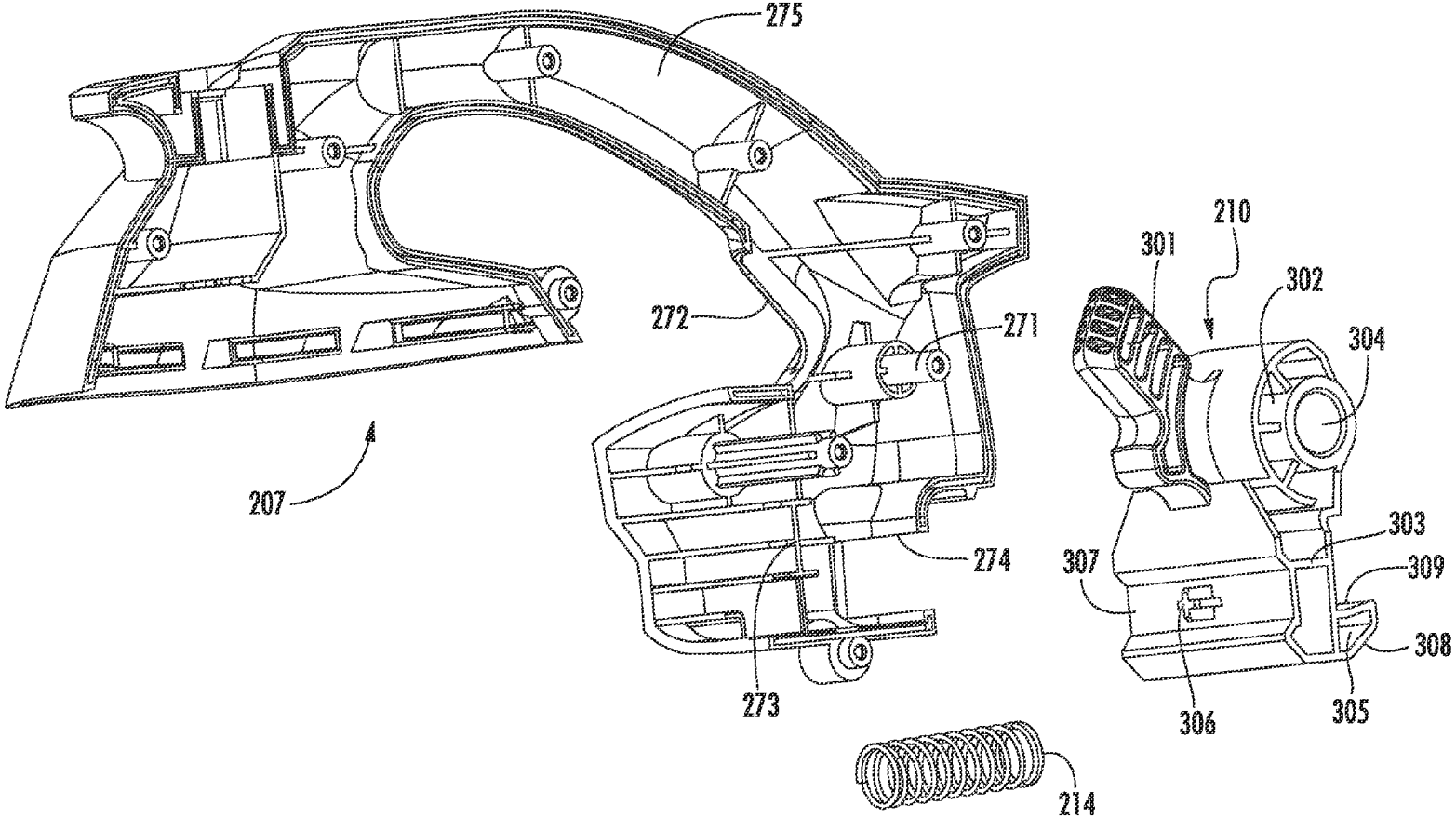
FIG. 11 is a partially exploded perspective view of a locking assembly and a handle of the vacuum cleaner in FIG. 9.
Figure 12:
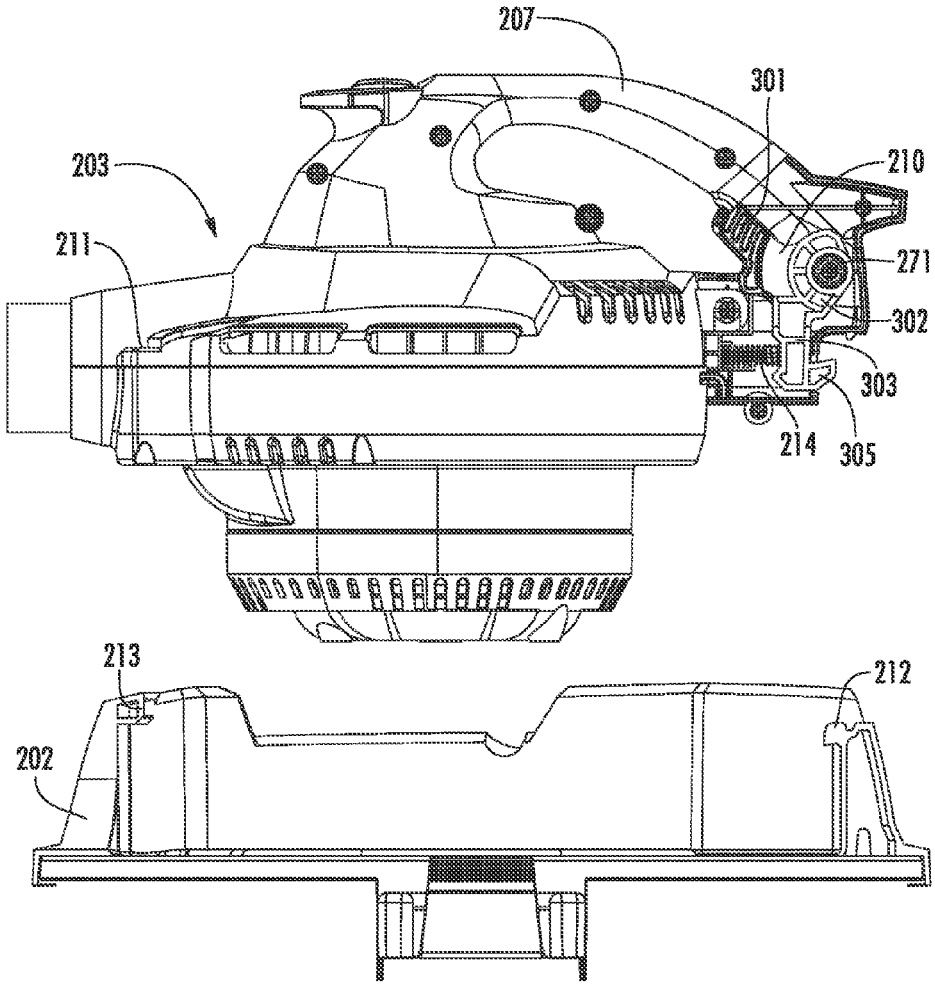
FIG. 12 is a partially exploded front planar view of the vacuum cleaner in FIG. 9.

Further referring to FIGS. 10 to 12, a locking assembly is arranged between the blower 203 and the tank cover 202, and includes a latch 210, a resilient member 214, and a plurality of engagement shoulders (not labeled). The latch 210 is mounted at the handle 207. The resilient member 214 is arranged between the latch 210 and the handle 207. The plurality of engagement shoulders includes a locking shoulder 212, a latching shoulder 213 and an abutting shoulder 211 engageable with the latching shoulder 213 and located at both sides of the wind outlet 209. The handle 207 is formed by two halves, and includes a grasp portion 275 and an opening 272 below the grasp portion 275. A center shaft 271 and a baffle 273 are formed in the grasp portion 275. The grasp portion 275 further defines a receiving opening 274 in a bottom portion thereof.

The latch 210 is independently formed and includes an activating portion 301, a rotating portion 302 and a latching portion 303. The rotating portion 302 defines a central hole 304 which rotatably encloses on the center shaft 271 for pivotally connecting the latch 210 with the handle 207. The activating portion 101 is partially embedded into the opening 72. The latching portion 303 includes a latch section 305, an abutting slot 307 and a positioning member 306 projected from a center of the abutting slot 307. The latch section 305 and the abutting slot 307 are located at opposite sides of the latching portion 303. The latch section 305 has a top face 309 and a slanted bottom face 308. One end of the resilient member 214 is enclosed on the positioning member 306 and abutting against the abutting slot 307, and the other end of the resilient member 214 is abutted against the baffle 273 of the handle 207. The resilient member 214 after assembly has an original position in a compressed state, so the latching portion 303 is pushed away from the baffle 273 by the resilient member 14, and the latch section 105 thereof is extended beyond the receiving opening 274, and latches with the locking shoulder 212, thereby locking the blower 203 with the tank cover 202.

Figure 13:
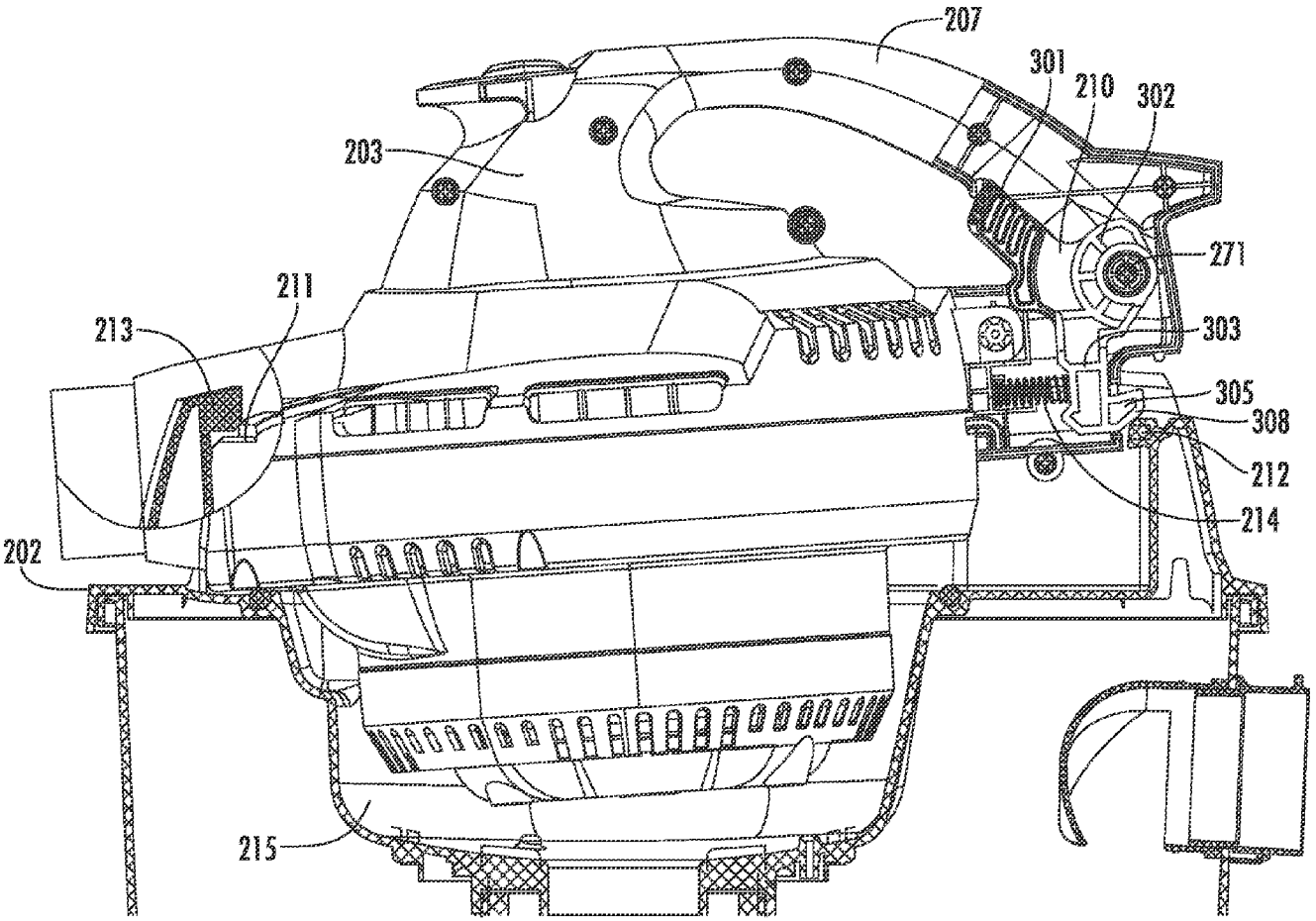
FIG. 13 is a partial sectional front view of the vacuum cleaner of FIG. 9 with the blower to be assembled to the tank cover in a first position.
Figure 14:
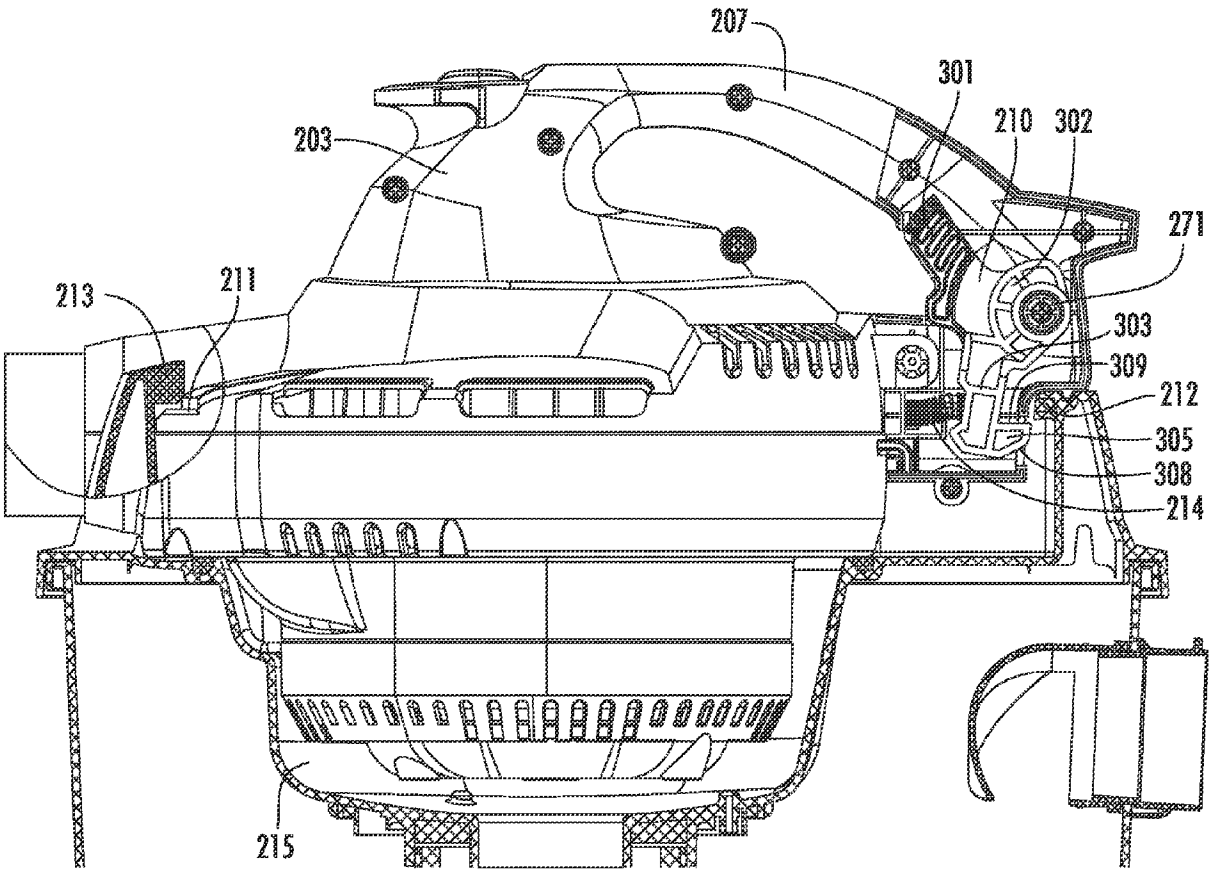
FIG. 14 is a partial sectional front view of the vacuum cleaner of FIG. 9 with the blower to be assembled to the tank cover in a second position.
Figure 15:
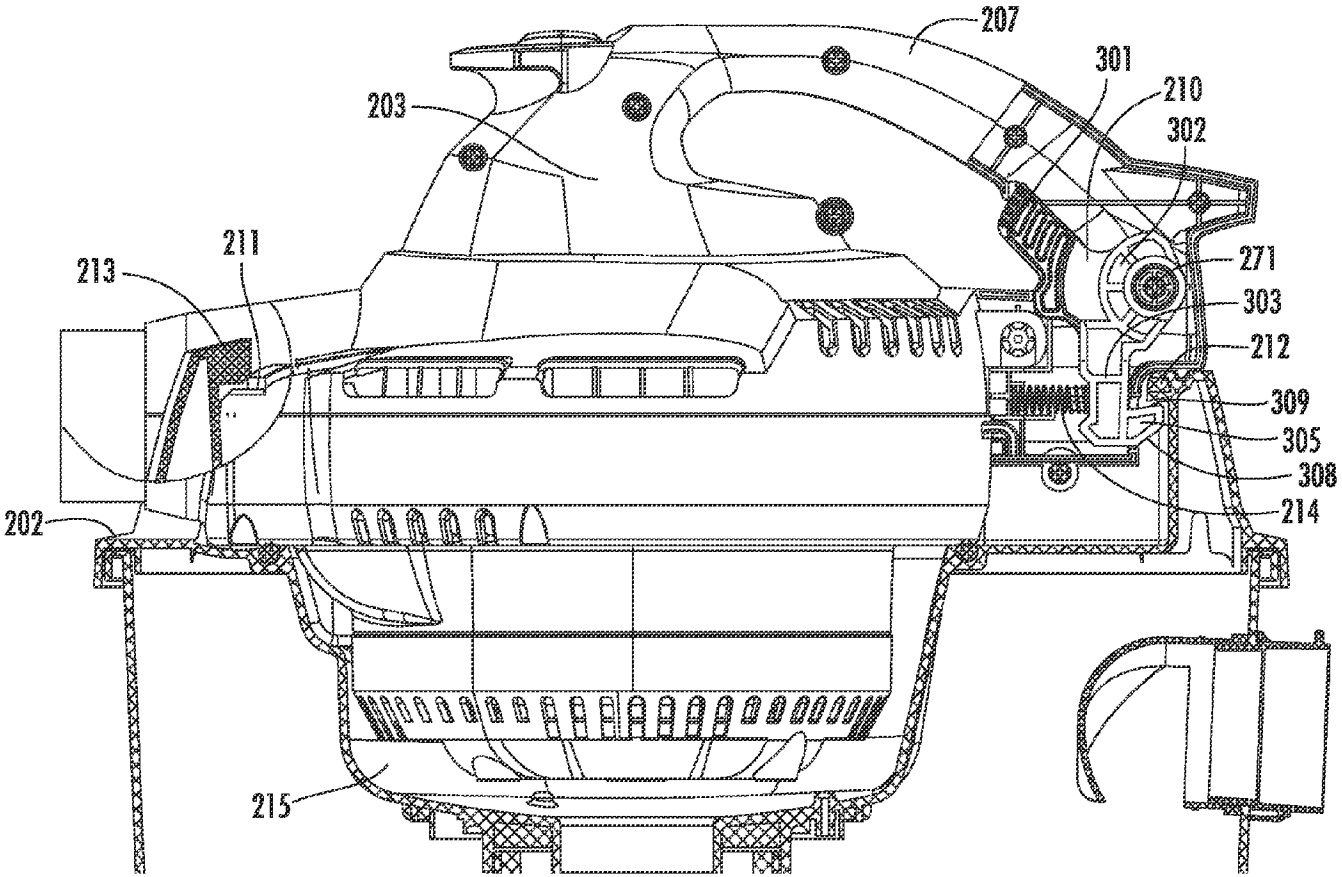
FIG. 15 is a partial sectional front view of the vacuum cleaner of FIG. 9 with the blower to be assembled to the tank cover in a third position.

FIGS. 13 to 15 show steps of the blower 203 assembly with the tank cover 202. As shown in FIG. 13, the abutting shoulder 211 of the blower 203 is firstly abutted beneath the latching shoulder 213, then the blower 203 is rotated about the engagement position between the abutting shoulder 211 and the latching shoulder 213 and toward the tank cover 202 till the bottom face 308 of the latch section 305 thereof contacts the locking shoulder 212; then, due to gravity of the blower 203 itself plus a pressing force on the latch section 305, the latching portion 303 of the blower 203 is rotated about the center shaft 271, toward a direction opposite to the locking shoulder 212 until the latch section 305 thereof is received into the receiving opening 274, accordingly, the blower 203 is successfully received into the receiving chamber 215. As shown in FIGS. 14 and 15, when the bottom face 308 disengages from the locking shoulder 212, the latch section 305 extends out from the receiving opening 274 due to resilient force of the resilient member 214 on the latching portion 303, thus, when the handle 207 of the blower 203 is carried upward, the top face 309 of the latch section 305 is latched with a bottom surface of the locking shoulder 212, thereby reliably locking the blower 203 with the tank cover 202.

When the blower 203 needs to be disconnected from the tank cover 202, starting in the position shown in FIG. 15 the activating portion 301 is firstly pushed upward to be received into the opening 272, and the latching portion 303, driven by the activating portion 301, is rotated in a direction opposite to the locking shoulder 212, so that the resilient member 214 is pressed and the latch section 305 is received into the receiving opening 274 toward the position shown in FIG. 14. Therefore, the top face 309 of the latch section 305 is disengaged from the locking shoulder 212 and at this time the blower 203 can be lifted upward. Then the abutting shoulder 211 is extracted out from the latching shoulder 213. Therefore, the blower 203 is completely extracted from the tank cover 202.

While preferred embodiments have been shown and described, those skilled in the art will recognize that changes and modifications may be made to the foregoing examples without departing from the scope and spirit of the invention. For example, specific styles and dimensions of various elements of the illustrated embodiments and materials used for those elements may be altered to suit particular applications and industry regulations. It is thus intended to claim all such changes and modifications as fall within the scope of the appended claims and their equivalents.

The invention claimed is:

1. A vacuum cleaner having a detachable blower, the vacuum cleaner comprising:

a dirt tank;

a tank cover mounted on the dirt tank;

a tank inlet extending through at least one of the dirt tank or the tank cover to provide a passage for transmitting material into the dirt tank;

a filter assembly within the dirt tank mounted to the tank cover;

a blower mounted on the tank cover so as to be detachable from the dirt tank, the tank cover and the filter assembly, the blower having a blower inlet in communication with the filter assembly and a blowing outlet, and including a main body and having a handle, the handle being a single handle on the main body and being located on a top face of the main body with a substantially symmetrical construction and including a central plane, the blower including a drive motor having a motor shaft with an axis substantially aligned with the central plane, the blower configured to draw material into the dirt tank via the tank inlet when the blower causes air to flow through the tank inlet, the filter assembly, the blower inlet and the blower outlet; and a locking assembly including a latch pivotally mounted on the blower, the locking assembly having an activating portion extending from an underside of the handle facing the top face and a latch section for selectively engaging the tank cover, thereby attaching or detaching the blower and the tank cover.

2. The vacuum cleaner having a detachable blower as claimed in claim 1, wherein the axis of the motor shaft is substantially coplanar with the central plane.

3. The vacuum cleaner having a detachable blower as claimed in claim 1, wherein the axis of the motor shaft is substantially parallel to the central plane.

4. The vacuum cleaner having a detachable blower as claimed in claim 1, wherein the blower includes a blowing outlet with a central plane coplanar with the central plane of the handle.

5. The vacuum cleaner having a detachable blower as claimed in claim 1, wherein the handle includes a front end portion extending upward from the top face of the blower, a rear end portion extending from a rear side of the main body, and a hand grip portion connecting the front end portion with the rear end portion.

6. The vacuum cleaner having a detachable blower as claimed in claim 1, wherein the blower includes a power switch arranged on the handle.

* * * * *